United States Patent [19]

Hamel et al.

[11] Patent Number: 4,955,470

[45] Date of Patent: Sep. 11, 1990

[54] PERSONAL UTILITY CONTAINER

[76] Inventors: Douglas M. Hamel; Linda J. Peralto, both of 34202 Del Obispo #49, Dana Point, Calif. 92629

[21] Appl. No.: 392,018

[22] Filed: Aug. 10, 1989

[51] Int. Cl.[5] ..... B65D 81/18

[52] U.S. Cl. ..... 206/213; 206/38; 206/205; 220/20.5; 220/22; 422/291

[58] Field of Search ..... 206/38, 205, 213, 278, 206/348; 220/20.5, 21, 22, 22.1; 239/55–60; 422/5, 28, 291, 306

[56] References Cited

U.S. PATENT DOCUMENTS

| | | | |
|---|---|---|---|
| 5,430 | 6/1873 | Aikin et al. | 206/213 |
| 1,739,730 | 12/1929 | Orthwine | 220/22 |
| 1,754,812 | 4/1930 | Zacharias | 220/22 |
| 2,572,669 | 10/1951 | Sarge et al. | 206/213 |
| 3,494,726 | 2/1970 | Barasch | 206/213 |
| 3,837,560 | 9/1974 | Kuchuris et al. | 220/22 |
| 4,229,415 | 10/1980 | Bryson | 422/306 |

*Primary Examiner*—Jimmy G. Foster

[57] ABSTRACT

A flexible false bottom utility container is presented. The container comprises a generally rectangular false bottom box fabricated from a strong light material and having a first true bottom. A generally rectangular cover is removeably coupled to cover the top of the box in a generally air tight coupling. A thin removable generally rigid false bottom divider having a plurality of small holes therethrough is supported a short distance above the true bottom by support means to form a volume beneath the false bottom communicating by passage of air with the rest of the interior of the box through the small holes through the false bottom. A selected fragrant material can be kept beneath the false bottom to impart a selected fragrance to the interior of the box. At least two generally rectangular shaped longitudinal dividers mate with at least two similar width dividers to form rectangular cross section compartments within the box for the storage of selected small items.

3 Claims, 2 Drawing Sheets

PERSONAL UTILITY CONTAINER

BACKGROUND OF THE INVENTION

1. Field of the Invention

The present invention relates to personal utility containers and storage boxes for small personal items.

2. Description of the Prior Art

The fiendish ability of small items to become lost is legendary. Any comedian is guaranteed a laugh if he starts talking about the special attachment of a washing machine that makes one but not both of a pair of socks disappear.

The obvious answer if one does not believe in magic and fairies is to better organize ones small personal articles. To assist in this organization, one by purchase one or more of a large variety of personal utility containers or drawer organizers. Drawer organizers are useful because the average dresser drawer is greater than one cubic foot in volume and disorganized, particularly after one loads in a large disorganized mess of personal items.

A variety of prior art scenting means are marketed, including the like. A variety of scenting materials such as cedar chests and the like. A variety of scenting materials such as potpourri are used to give a pleasant scent to a variety of small personal items from stationary to stockings. Unfortunately, the potpourri loses its scent and therefore its usefulness in a month or two. This is an inconvenience, because if one wants to continue giving ones small personal items the desired pleasant scent, one must continually replace the potpourri.

What is needed but not disclosed by the prior art is a flexible personal utility container capable of storing a variety of small personal items and permitting the giving of a pleasant scent to said items by potpourri or the equivalent in such a manner that the potpourri lasts about five times as long before losing its potency, thereby relieving the owner from the constant need to purchase more potpourri to replace the old potpourri which has lost its scent.

SUMMARY OF THE INVENTION

A flexible false bottom personal utility container is presented.

The container comprises a generally rectangular false bottom box fabricated from a strong, light material and having interior walls defining a rectangular cross section in two dimensions interior, and having a first bottom surface forming a true interior bottom.

A thin removable generally rigid rectangular planar false bottom divider comprises two parallel planar surfaces disposed a short distance apart. Said planar surfaces have dimensions incrementally smaller than the interior length and width dimensions of the box a short distance above the true bottom of the box and have interior surfaces defining a selected plurality of small holes therethrough by means of which holes a small amount of air can flow to and from the volume between the false bottom divider and the true bottom and that portion of the interior of the box above the false bottom.

Support means capable of supporting the planar false bottom divider a selected short distance above the true bottom surface may comprise pillars or any prior art compatible support means.

A generally rectangular cover is capable of removeably coupling to the exterior surface of the top of the box in a tight generally air tight coupling.

At least two identical generally rectangular shaped longitudinal dividers comprise identical parallel generally planar surfaces of length incrementally less than the interior length of the box and of height approximately equal to the height of the interior of the box above the false bottom. Each longitudinal divider has interior surfaces defining slits parallel to the ends thereof. The slits are of width substantially equal to the thickness of width dividers so that the longitudinal dividers can couple at the slits with width dividers. The slits are of length at least half and approximately half the height of the longitudinal dividers.

At least two identical generally rectangular shaped width dividers comprise parallel planar rectangular surfaces of length incrementally less than the interior width of the box, and of height substantially equal to the height of the interior of the box above the false bottom. Each width divider has interior surfaces defining slits parallel to the ends thereof. The slits are of width substantially equal to the thickness of the width dividers which is equal to the width of the longitudinal dividers. The slits are of length at least half and approximately half the height of the width dividers.

A selected fragrant material may be disposed between the false bottom and the true bottom.

In one example of the invention, the longitudinal dividers and width dividers are coupled together by their slits to form a tic tac toe like matrix having the dimensions of the interior of the box, which matrix is placed in and mated, usually removably mated, to the interior surfaces of the box.

DRAWING DESCRIPTION

Reference should be made at this time to the following detailed description which should be real in conjunction with the following drawings of which:

DETAILED DESCRIPTION OF THE INVENTION

Figure 2:
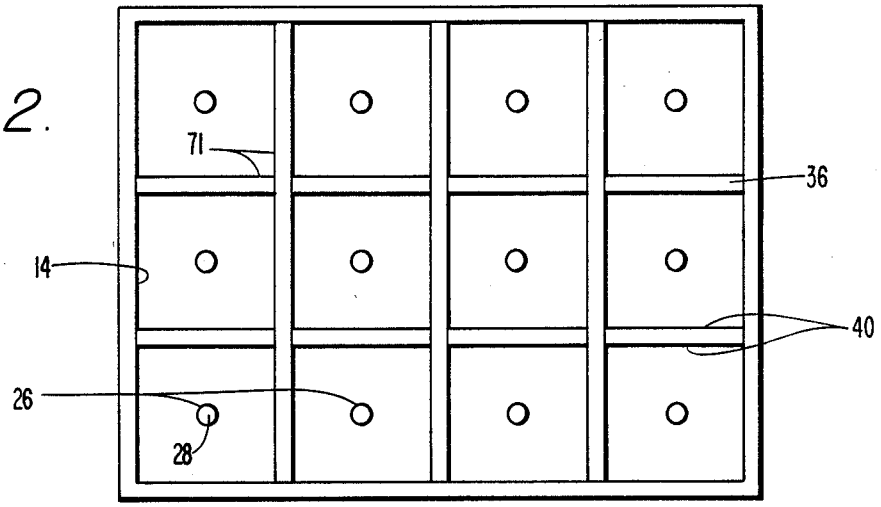
FIG. 2 is a top view of the box of the invention.
Figure 1:
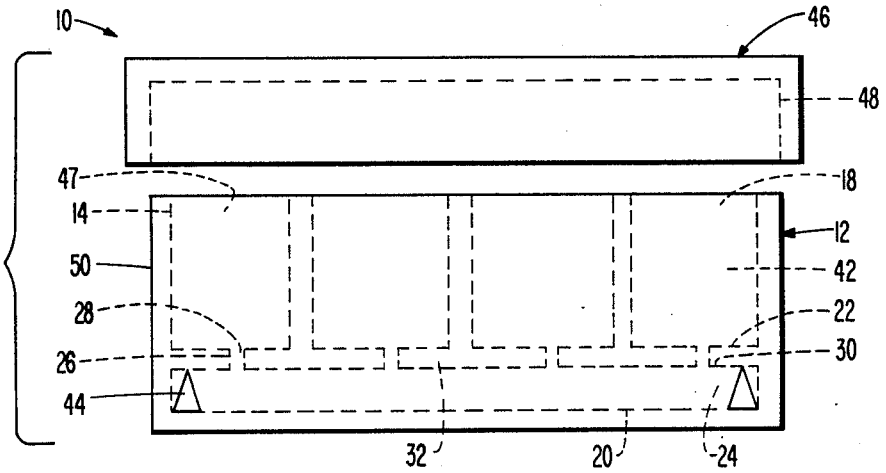
FIG. 1 is a side view of the invention showing a box with a cover slightly above the box.
Figure 3:
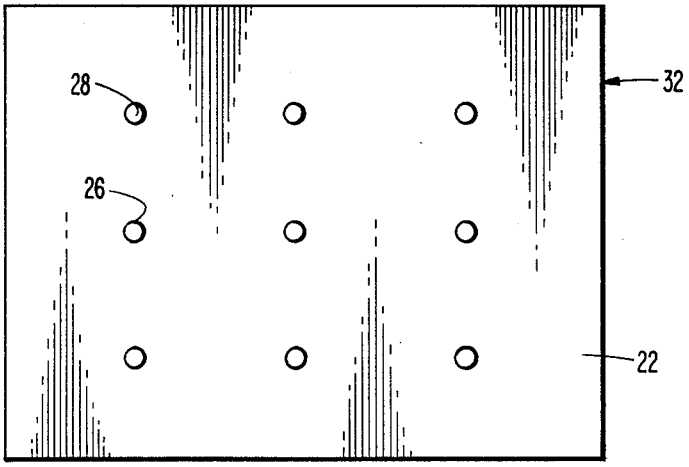
FIG. 3 is a top view of a false bottom of the box of the invention.
Figure 4:
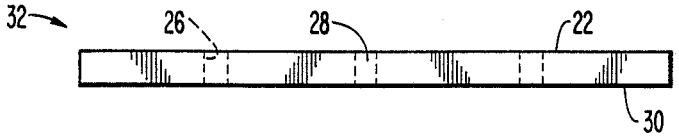
FIG. 4 is a side view of the false bottom of the box of the invention.
Figure 5:
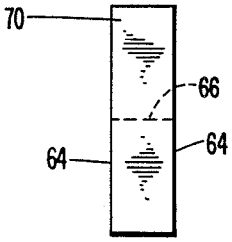
FIG. 5 is an end view of a width divider of the box of the invention.
Figure 7:
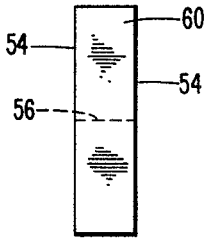
FIG. 7 is an end view of a length divider of the box of the invention.
Figure 6:
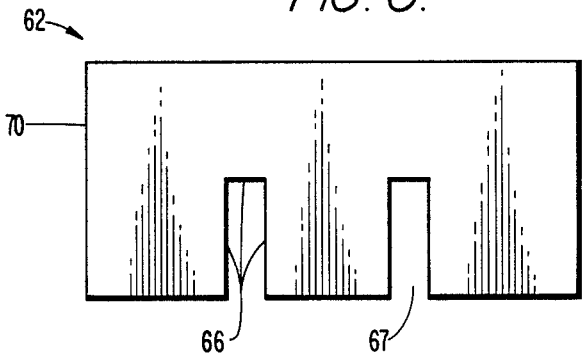
FIG. 6 is a side view of the width divider of FIG. 5.
Figure 8:
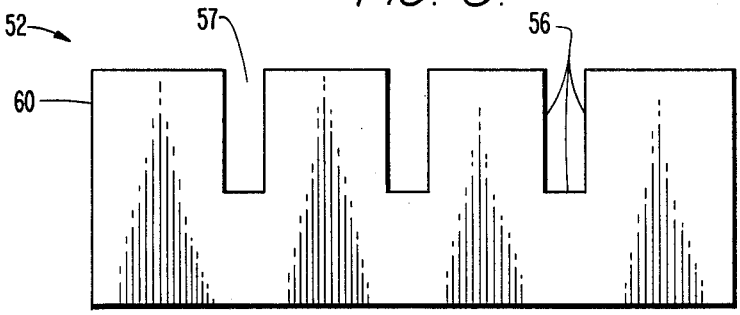
FIG. 8 is a side view of the length divider of FIG. 7.

Reference should be made at this time to FIGS. 1–8 which show various views of the invention. A false bottom personal utility container 10 is presented.

The container 10 comprises a generally rectangular false bottom 32 box 12 fabricated from a strong, light material such as one of the transparent plastics and having interior walls 14 defining a rectangular cross section in two dimensions interior 18, and having a first bottom interior surface 20 forming a true interior bottom 20.

A thin removable generally rigid rectangular planar false bottom divider 32 comprises two parallel planar surfaces 22 disposed a short distance apart. Said planar surfaces 22 have dimensions incrementally smaller than the interior length and width dimensions of the box 12 a short distance above the true bottom 20 of the box 12 and have interior surfaces 26 defining a selected plurality of small holes 28 therethrough by means of which holes 28 a small amount of air (not shown) can flow to and from the volume 24 between the false bottom divider 32 and the true bottom 20 and that portion 42 of the interior 18 of the box 12 above the false bottom 32.

Support means 44 capable of supporting the planar false bottom divider 32 a selected short distance above the true bottom surface 20 may comprise pillars 44 or any prior art compatible support means.

A generally rectangular cover 46 has an interior surface 48 which interior surface 48 is capable of removeably coupling to the exterior surface 50 of the top 47 of the box 12 in a tight generally air tight coupling.

At least two identical generally rectangular shaped longitudinal dividers 52 comprise identical parallel generally planar surfaces of length incrementally less than the interior length of the box 12 and of height approximately equal to the height of the interior of the box 12 above the false bottom 32. Each longitudinal divider 52 has interior surfaces 56 defining slits 57 parallel to the ends 60 of the longitudinal divider. The slits 57 are of width substantially equal to the thickness of the width dividers 62 so that the longitudinal dividers 52 can couple at the slits 57 with slits 67 of the width dividers 62. The slits 57 are of length at least half and approximately half the height of the longitudinal dividers 52.

At least two identical generally rectangular shaped width dividers 62 comprise parallel planar rectangular surfaces 64 of length incrementally less than the interior width of the box 12, and of height substantially equal to the height of the interior of the box 12 above the false bottom 32. Each width divider 62 has interior surfaces 66 defining width divider slits 67 parallel to the ends 70 of the width dividers. The slits 67 are of width substantially equal to the thickness of the width dividers 62 which is equal to the width of the longitudinal dividers 52. The slits 57, 67 are of length at least half and approximately half the height of the width dividers 62. To assemble the dividers 52, 62, the longitudinal dividers 52 are placed parallel a distance apart equal to the distance between slits 67 of the width dividers 62 with the slits 57 of the longitudinal dividers 52 in an identical orientation. The slits 67 of the width dividers 62 are then mated to the slits 57 of the longitudinal dividers 52 to form a matrix 71 comprising the width dividers 62 and longitudinal dividers 52 which matrix is placed in and mated to the interior surfaces 14 of the box 12.

A selected fragrant material such as potpourri may be disposed between the false bottom and the true bottom.

A particular example of the invention has been described herein. Other examples, including rearrangements of the elements of the container 10 will be obvious to those skilled in the art. The invention is limited only by the following claims.

What is claimed is:

1. A flexible false bottom personal utility container, comprising:

a generally rectangular false bottom box fabricated from a strong, light material and having interior walls defining a rectangular cross section in two dimensions interior, and having a first bottom surface forming a true interior bottom;

a thin removable generally rigid rectangular planar false bottom divider comprising two parallel planar surfaces disposed a short distance apart and said planar surfaces having dimensions incrementally smaller than the interior length and width dimensions of the box a short distance above the true bottom of the box and having interior surfaces defining a selected plurality of small holes therethrough by means of which holes a small amount of air can flow to and from the volume between the false bottom divider and the true bottom and that portion of the interior of the box above the false bottom;

support means capable of supporting the planar false bottom divider a selected short distance above the true bottom surface;

a generally rectangular cover capable of removeably coupling to the exterior surface of the top of the box in a tight generally air tight coupling;

at least two identical generally rectangular shaped longitudinal dividers comprising identical planar generally planar surfaces of length incrementally less than the interior length of the box and of height approximately equal to the height of the interior of the box above the false bottom, each having interior surfaces defining slits parallel to the ends thereof, the slits of width substantially equal to the thickness of the dividers and the slits of length at least half and approximately half the height of the longitudinal dividers; and at least two identical generally rectangular shaped width dividers comprising parallel planar rectangular surfaces of length incrementally less than the interior width of the box, and of height substantially equal to the height of the interior of the box above the false bottom, each having interior surfaces defining slits parallel to the ends thereof, the slits being of width substantially equal to the thickness of the width dividers which is equal to the width of the longitudinal dividers and the slits of length at least half and approximately half the height of the width dividers.

2. The invention of claim 1, further including a selected fragrant material disposed between the false bottom and the true bottom.

3. The invention of claim 1 wherein the longitudinal dividers and width dividers are coupled together by their slits to form a tic tac toe like matrix having the dimensions of the interior of the box.

* * * * *